US006736632B2

(12) United States Patent
Wolter

(10) Patent No.: US 6,736,632 B2
(45) Date of Patent: May 18, 2004

(54) DECORATIVE CAKE PROTECTOR

(76) Inventor: Fleur Nanette Wolter, 82 Seaforth Crescent, Seaforth, NSW 2092 (AU)

( * ) Notice: Subject to any disclaimer, the term of this patent is extended or adjusted under 35 U.S.C. 154(b) by 0 days.

(21) Appl. No.: 10/277,609

(22) Filed: Oct. 22, 2002

(65) Prior Publication Data

US 2003/0129559 A1 Jul. 10, 2003

(30) Foreign Application Priority Data

Oct. 22, 2001 (AU) ..... PR8378

(51) Int. Cl.[7] ..... F23D 3/16

(52) U.S. Cl. ..... 431/295; 431/296; 431/253

(58) Field of Search ..... 431/295, 296, 431/253, 288, 292; 312/284, 280; 206/45.32, 542; D7/610, 83

(56) References Cited

U.S. PATENT DOCUMENTS

| | | | | | |
|---|---|---|---|---|---|
| 1,125,855 | A | * | 1/1915 | Mapes | 431/295 |
| 2,960,770 | A | * | 11/1960 | Valenta | 431/296 |
| 4,721,455 | A | * | 1/1988 | Barfus | 431/295 |
| 4,884,966 | A | * | 12/1989 | Wexler | 431/295 |
| D312,756 | S | * | 12/1990 | Crisci | D7/610 |
| 5,673,802 | A | * | 10/1997 | Valentino | 431/295 |

* cited by examiner

*Primary Examiner*—James C. Yeung
(74) *Attorney, Agent, or Firm*—Greenberg Traurig LLP

(57) ABSTRACT

A decorative cake protector (1) for use on a cake (2) is disclosed in which the protection includes a shield (5) for protecting the cake from the residue or debris of at least one burning device (16,17), a support (16*a*,17*a*) for holding the burning device above the cake; and a decorative theme piece (10) mounted above the shield. The decorative cake protector preferably includes a stand (12) to space the shield from the cake surface.

12 Claims, 5 Drawing Sheets

DECORATIVE CAKE PROTECTOR

THE TECHNICAL FIELD

This invention relates to a decorative cake protector. More particularly, this invention relates to a decorative cake protector for shielding a cake from the residue and byproducts of burning devices.

BACKGROUND OF THE INVENTION

Persons skilled in the art of cake making will be familiar with the problems associated with burning the traditional and entertainment devices such and wick candles and sparklers on cakes such as birthday cakes. Wax tends to drip down from wax candles onto the icing or other surface of the cake and debris from the sparklers commonly falls onto the cake surface having undesirable health implications or, at the very least, leaving a distasteful residue.

It is an object of the present invention to alleviate the above mentioned problems of the prior art or to at least provide a useful alternative thereto.

SUMMARY OF THE INVENTION

Accordingly, the invention provides in one aspect a decorative cake protector for use on a cake, the protector comprising:

- a shield for protecting the cake from the residue or debris of at least one burning device
- a support for holding the burning device above the cake; and
- a decorative theme piece mounted above the shield.

Preferably the decorative cake protector includes a stand to space the shield from the cake surface. The stand itself may rest directly on the surface of the cake. The stand may be in the form of spacing means to ensure that the under surface of the shield does not rest directly on the top surface of the cake, especially in situations where the surface is for example soft (eg made of cream or soft icing).

The shield may be adapted to move relative to the stand. For example, the shield may be rotationally mounted on the stand. Preferably, however, the shield is mounted in fixed relationship to the stand.

The spacing means may serve to leave undamaged any decoration on the top surface of the cake. The spacing means may be adapted to engage a side surface or wall of the cake. The spacing means may be adapted to support the protector over the cake without touching same. For example, the protector may include "spider legs" extending over or around the cake to rest on a support surface such as a table.

The shield and the stand may be separate components or may be integrally formed.

The shield and the stand may also contribute to the overall effect of the decorative theme piece, the whole protector thus being decorative.

In certain situations, there may be provided a secondary larger shield to protect particularly large cakes.

Whilst it will be understood that the burning devices are located above the shield, it may be useful in certain situations to allow the candle mounts and/or prongs of the sparklers to extend through the shield and rest on the cake thereby improving the overall stability of the cake protector.

The protector may be made from a variety of materials suitable for the purpose. For example, the protector may be made from moulded plastic cardboard, cardboard with a metal skin or full or woven material. Preferably, the protector is fire resistant and accordingly its surface may include a fire retardant. However, because the protector is likely to come into direct contact with food, any materials used in the protector should be "food safe" in accordance with the regulations in any particular jurisdiction.

The shield may include a range of designs. For example, the shield may be fluted. The shield may be shaped like the wings of the Opera House. Preferably, however the shield is planar. The shield when viewed from a top elevation may, be any of a number of shapes. For example, the shield may be rectangular, square, oval or triangular. Preferably, the shield is circular when viewed from a top elevation.

The decorative cake protector may include cutting means to pre-cut the cake. For example the cutting means may be in the form of downwardy depending blade panels attached to the underside of the protector means.

The support may extend upwardly from the shield. The support may form part of the shield. The support may include apertures for receiving mounting or other portions of the burning device, such as the wire handle of a sparklers or the tapered base of a candle.

The decorative theme piece may be mounted on the shield. The decorative theme piece may include a large variety of shapes and designs suitable for the occasion. For example, a birthday cake for a children's party might include a theme piece in the form of a ballerina, rocket ship, sportsman, horse and rider, or feature any one of a number characters associated with the entertainment industry. The decorative theme piece may be stationary relative to the cake.

The decorative theme piece may be dynamic. For example, the decorative theme piece may be rotatable relative to the cake. The burning device may provide propulsion in order to rotate the decorative theme piece. The decorative theme piece may be adapted to pivot or oscillate by means, for example, of a spring mounting. The decorative then piece may be in the form of a "jack in the box" in which a character or other object consistent with the theme emerges from a box or other hideaway.

The decorative cake protector may be formed in a number of ways. The decorate cake protector may include a number of components which may be pre-assembled prior to purchase or sold as blanks which may be assembled after purchase. The shield may include mounting means for receiving the support and the decorative theme piece. The shield may include slots through which the support and or the decorative theme piece may be inserted for mounting. The support and/or the theme piece may include stamped out blanks adapted to slot together or otherwise co-operate to form a unitary three dimensional display.

The decorative cake protector may be integrally moulded in one piece or formed from number of moulded pieces. The protector may be painted or otherwise coloured according to the theme.

Preferably, the decorative cake protector as a whole is formed from a number of cardboard stamped blanks adapted to be slotted together to form the decorative cake protector in suitable three dimensional arrangement.

It will be understood that whilst the cake protector will normally be used in conjunction with a cake, there may be situations in which the cake protector may be used in stand alone mode for example as a simple celebration decoration which functionally holds candles, sparklers and possibly treats (lollypops).

BRIEF DESCRIPTION OF THE DRAWINGS

The invention may be better understood from the following non-limiting description of one or more preferred embodiments, in which.

DETAILED DESCRIPTION OF THE DRAWINGS

Figure 1:
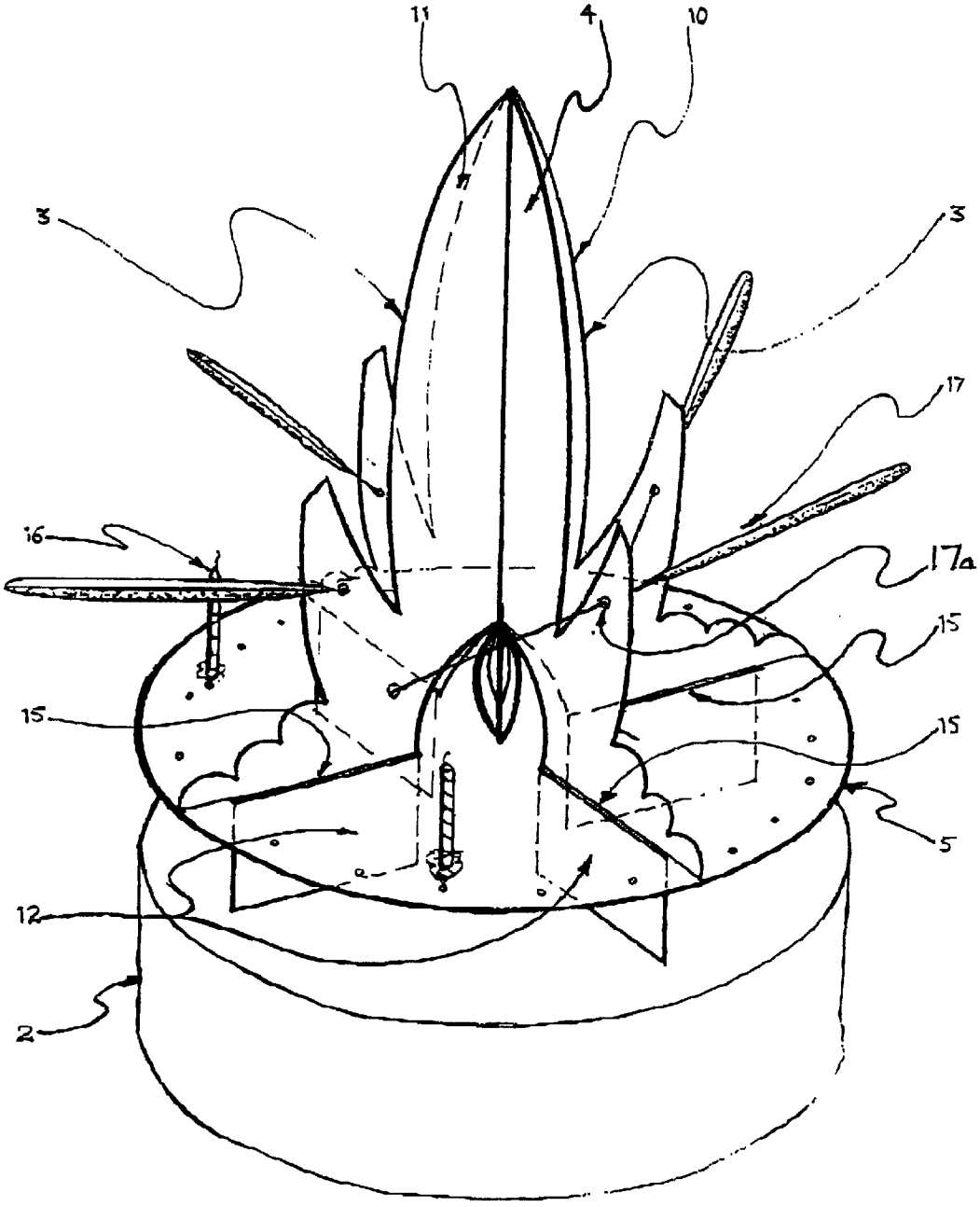
FIG. 1 is a perspective view of a first embodiment.

Turning to FIGS. 1 to 4, there is shown a decorative cake protector 1 stationarily mounted on a cake 2. The decorative cake protector 1 includes a shield 5 adapted to cover the top surface of the cake 2. The decorative cake protector 1 includes a decorative theme piece 10 in the form of a rocket ship. The piece 10 is formed from cardboard cutouts or stamps made from cardboard blanks which are slotted together to form a three dimensional structure having a pair of blanks slotted into one another to engage and form two pairs of diametrically opposed wings 3 and 4.

The piece 10 includes an upper portion 11 bearing the theme and a lower portion 12 serving as space means to space the shield 5 from the cake 2. The piece extends through suitably placed slots 15 in the shield 5 whereby to locate the piece 10 as a stable structure having four wings 3, 4 in the protective shield 5.

The protector 1 includes supports for mounting burning devices in the form of candles 16 and sparklers 17. The support means is in the form of apertures 16*a*, 17*a* through which the handles of the sparklers 17 or the tapered bases of the candles 16 may be inserted.

In operation it can be seen that upon lighting the sparklers and the candles the debris and residue derived therefrom does not fall upon the top surface of the cake 2. The protective shield 5 serves as a barrier to stop residue and debris which would otherwise have fallen on the top surface of the cake 2.

Figure 2:
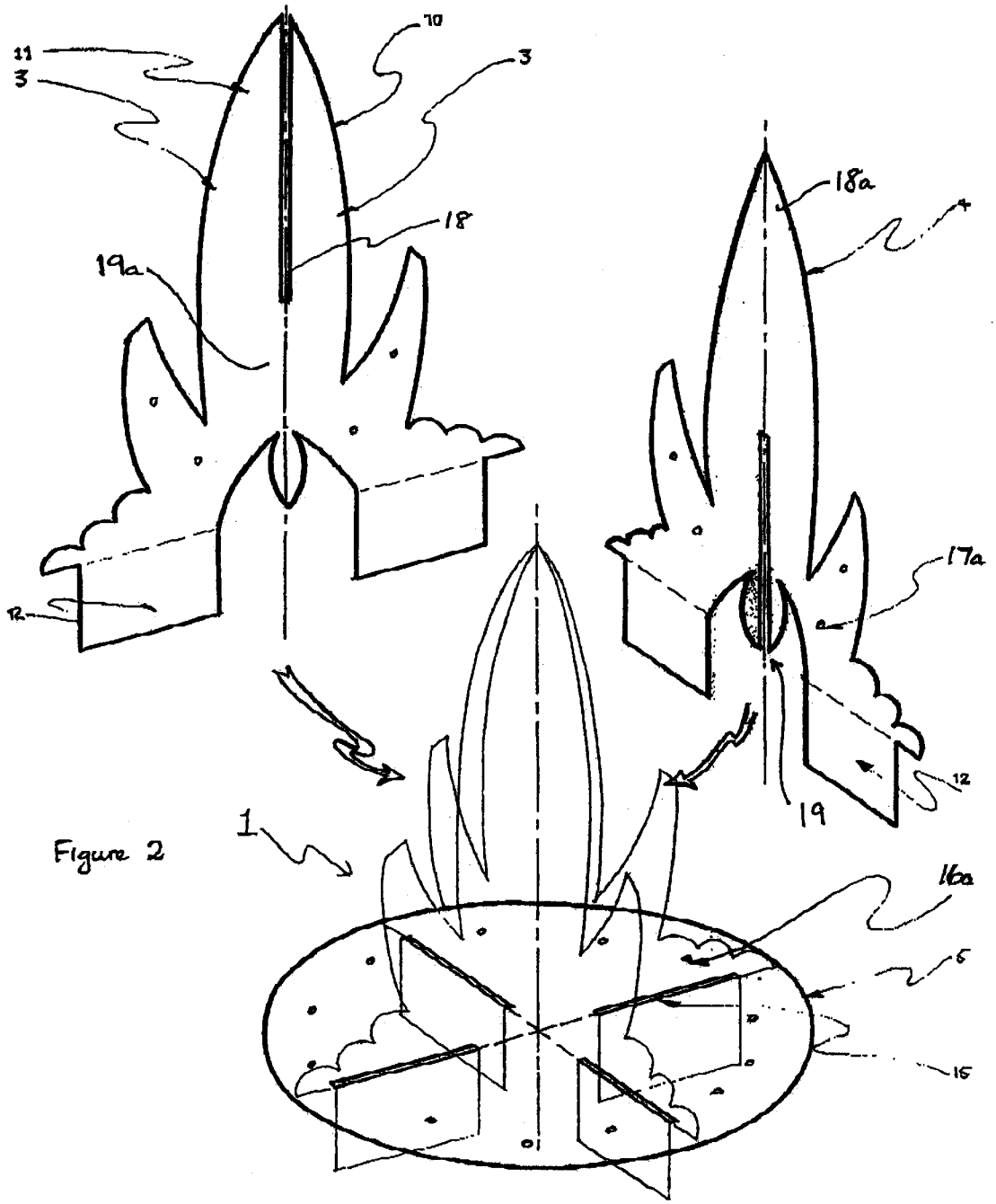
FIG. 2 is an exploded view of the first embodiment showing how the component part fit together.

FIG. 2 shows an exploded view of the decorative cake protector 1 illustrating how the component parts 5 and 10 fit together. Each wing 3,4 has a slot for engaging the other wing 3,4. As shown in FIG. 2, wing 3 has an upper slot 18 adapted to engage the upper region 18*a* of wing 4 and wing 4 has a lower slot 19 adapted to engage the lower region 19*a* of wing 3 whereby, in plan view, the piece 10 is in the form of a cross. The downwardly depending spacers of the lower portion 12 can be inserted into the shield slots 15 (see FIG. 4) so that the lower portion is adapted to space the shield 5 from the top surface of the cake. Sparklers 17 and/or candles 16 can then be added to complete the assembly of the protector 1.

Figure 3:
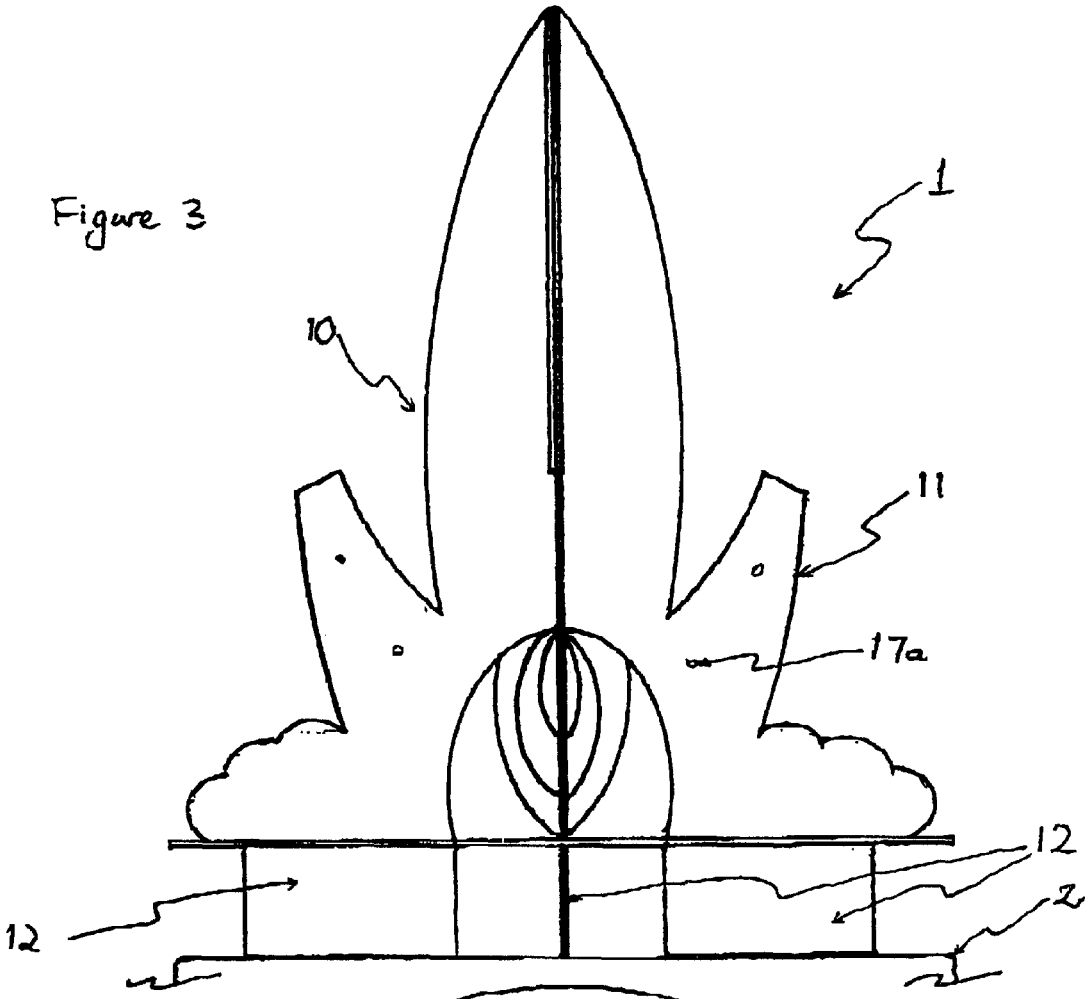
FIG. 3 is a side elevation of The first embodiment.
Figure 4:
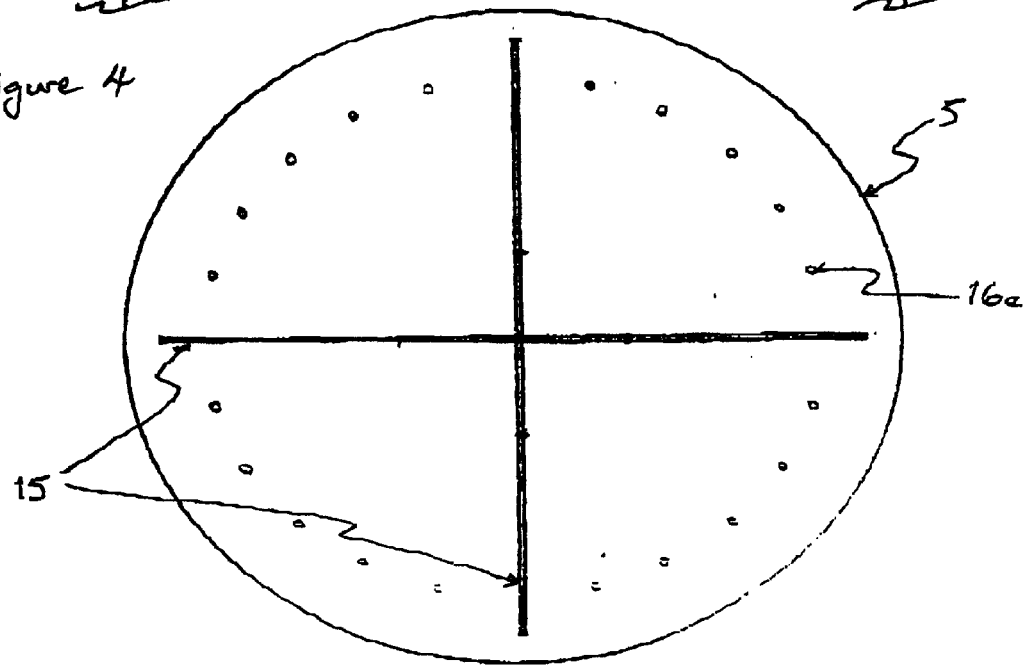
FIG. 4 is a plan view of the first embodiment.

FIG. 3 more clearly shows the operation of the space means 12 which ensures that the underside of the protective shield 5 does not come into direct contact with the top surface of the cake 2.

Figure 5:
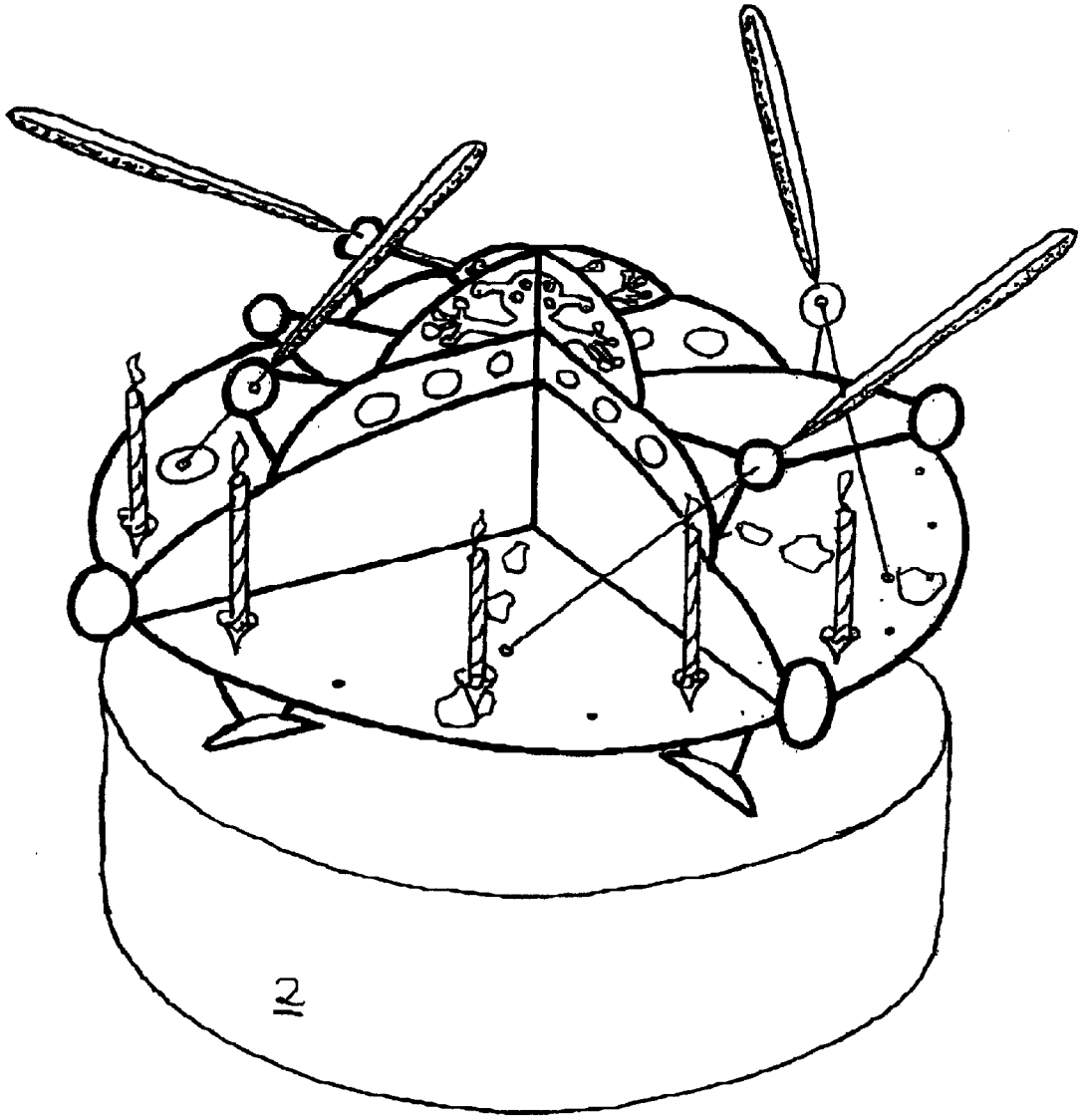
FIG. 5 is a perspective view of a second embodiment.
Figure 6:
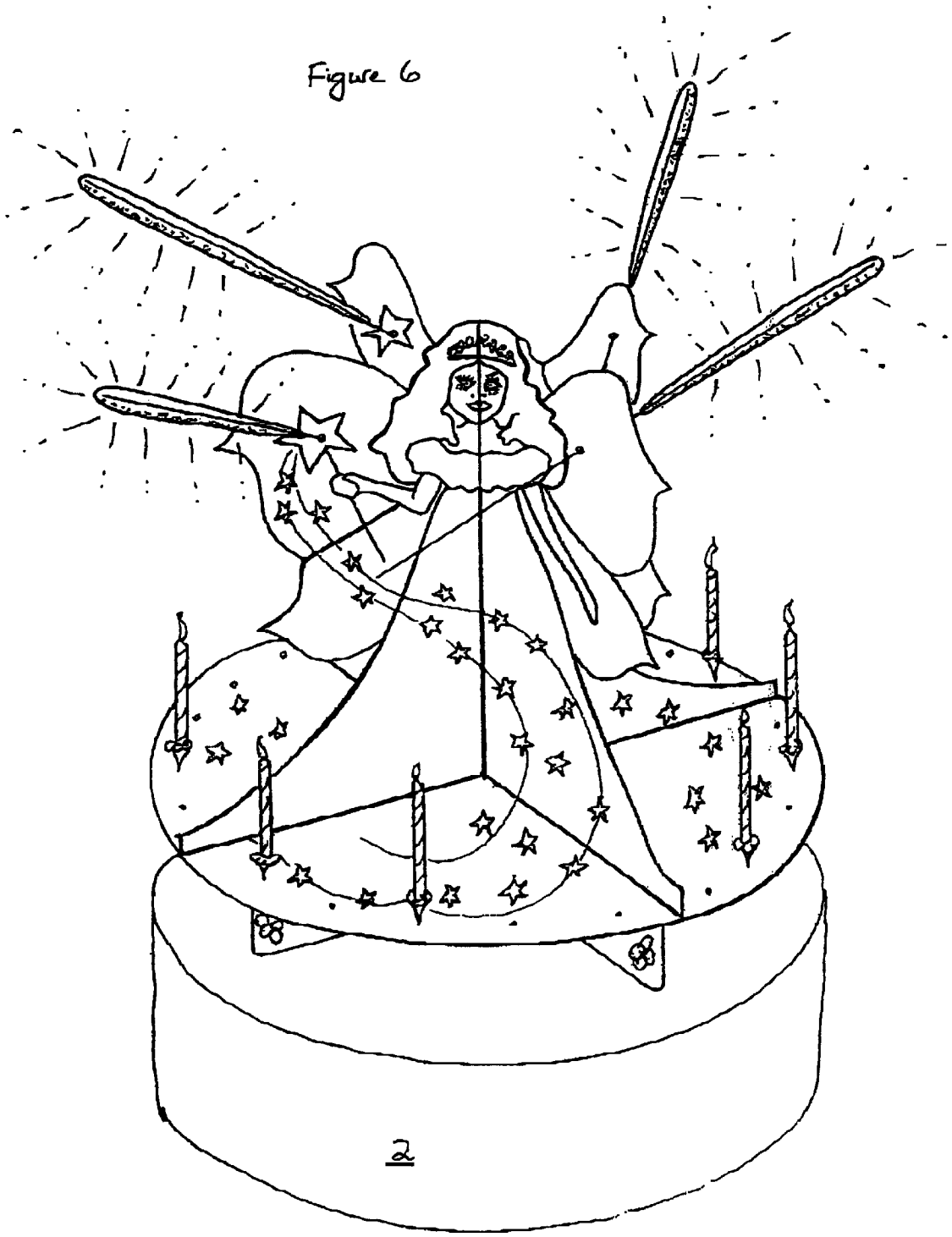
FIG. 6 is a perspective view of a third embodiment

FIGS. 5 and 6 illustrate the variety of themes which may be used in accordance with the invention. In FIG. 5 there is shown a protector with an alien spaceship them and FIG. 6 shows a fairy theme.

Throughout the specification the word "comprise" and its derivatives are intended to have an inclusive meaning rather than an exclusive meaning unless the context require otherwise.

It will be appreciated by those skilled in the art that many modifications and variations may be made to the embodiments described herein without departing from the spirit or scope of the invention.

What is claimed is:

1. A decorative cake protector for use on a cake, the protector being formed from a number of components including:

a shield for protecting the cake from the residue or debris of at least one burning device;

a support for holding a burning device above the cake;

a decorative theme piece mounted above the shield; and a stand to space the shield from the cake surface;

wherein the shield includes mounting means for receiving the support and decorative theme piece.

2. A decorative cake protector according to claim 1, in which the mounting means for receiving the support and the decorative theme piece are in the form of slots through which the support and the decorative theme piece are inserted for mounting.

3. A decorative cake protector according to claim 2, wherein the support and the theme piece are in the form of stamped out blanks adapted to slot together to form a unitary three dimensional display.

4. A decorative cake protector according to claim 3, wherein the protector is in the form of a fully assembled decorative cake protector kit, prior to purchase.

5. A decorative cake protector according to claim 3, wherein the protector is in the form of a kit of a number of unassembled components, prior to purchase.

6. A decorative cake protector according to claim 3, wherein the support includes apertures for receiving mounting or other portions of the burning device, such as the wire handle of a sparkler or the tapered base of a candle.

7. A decorative cake protector according to claim 1, wherein the decorative cake protector as a whole is formed from a number of cardboard stamped blanks adapted to be slotted together to form the decorative cake protector in suitable three dimensional arrangement.

8. A decorative cake protector for use on a cake, the decorative cake protector comprising:

a shield, configured to be positioned above an upper surface of a cake, for protecting the upper surface of the cake from foreign objects;

a decorative theme piece positioned above the shield;

a stand, substantially disposed below the shield and configured to rest on the upper surface of the cake, for maintaining the shield in spaced relationship above the upper surface of the cake, wherein the decorative theme piece and the stand are integrally and cooperatively formed together;

at least one support for holding a burning device above the cake.

9. The decorative cake protector according to claim 8, wherein:

the at least one support is disposed in at least one of the shield and the decorative theme piece.

10. The decorative cake protector according to claim wherein each of the shield, decorative theme piece, stand, and at least one support are all fabricated from cardboard material.

11. The decorative cake protector according to claim 8, wherein the decorative theme piece and the stand comprise a single, monolithically formed structure, and further wherein the stand comprises at least one downwardly projecting element configured to project through a corresponding at least one aperture disposed in the shield.

12. The decorative cake protector according to claim 8, wherein the decorative theme piece and the stand comprise at least two interfitting elements, provided with cooperating aligning slots, so that the at least two interfitting elements can be slotted together to form a self-supporting composite decorative theme piece and stand.

* * * * *